US008827878B1

(12) United States Patent
Ciminski et al.

(10) Patent No.: US 8,827,878 B1
(45) Date of Patent: Sep. 9, 2014

(54) WEIGHT BAR CLAMP

(75) Inventors: John A. Ciminski, Apache Junction, AZ (US); Verl E. Miller, LaGrande, OR (US); James Hawthorne, Vancouver, WA (US); Jeffrey P. Baldwin, Phoenix, AZ (US)

(73) Assignee: MCR Strength Inc., Apache Junction, AZ (US)

( * ) Notice: Subject to any disclaimer, the term of this patent is extended or adjusted under 35 U.S.C. 154(b) by 199 days.

(21) Appl. No.: 13/482,707

(22) Filed: May 29, 2012

(51) Int. Cl.
*A63B 21/06* (2006.01)

(52) U.S. Cl.
USPC ..... 482/107; 482/93

(58) Field of Classification Search
CPC .. A63B 21/06; A63B 21/072; A63B 21/0724; A63B 21/0726; A63B 21/0728; A63B 21/075; A63B 21/078
USPC ..... 482/92–93, 106–107; 403/17–18, 403/373–374.5
See application file for complete search history.

(56) References Cited

U.S. PATENT DOCUMENTS

| | | | | | |
|---|---|---|---|---|---|
| 2,244,351 | A | * | 6/1941 | Venables | 482/107 |
| 3,177,551 | A | | 4/1965 | Engman | |
| 3,204,991 | A | | 9/1965 | Hauk | |
| 3,305,234 | A | * | 2/1967 | Cline et al. | 482/107 |
| 3,828,403 | A | | 8/1974 | Perrin et al. | |
| 4,054,394 | A | | 10/1977 | Neuman | |
| 4,111,575 | A | | 9/1978 | Hoshino | |
| 4,529,197 | A | * | 7/1985 | Gogarty | 482/107 |
| 4,573,717 | A | | 3/1986 | Peacolk | |
| 4,585,367 | A | * | 4/1986 | Gall | 403/104 |
| 4,619,545 | A | | 10/1986 | Kuttenbaum | |
| 4,639,979 | A | * | 2/1987 | Polson | 482/107 |
| 4,643,460 | A | | 2/1987 | Lieberg | |
| 4,646,398 | A | | 3/1987 | Myhrman | |
| 4,669,911 | A | | 6/1987 | Lundgren et al. | |
| 4,761,092 | A | | 8/1988 | Nakatani | |
| 4,817,944 | A | * | 4/1989 | Anderson et al. | 482/107 |
| 5,062,631 | A | * | 11/1991 | Dau et al. | 482/107 |
| 5,295,933 | A | * | 3/1994 | Ciminski et al. | 482/107 |
| 5,380,338 | A | * | 1/1995 | Christian | 606/130 |
| 5,605,411 | A | * | 2/1997 | Wilson et al. | 403/325 |
| 5,735,777 | A | * | 4/1998 | Benoit et al. | 482/93 |
| 6,948,878 | B1 | * | 9/2005 | Smith et al. | 403/110 |

(Continued)

FOREIGN PATENT DOCUMENTS

| | | |
|---|---|---|
| DE | 3738360 | 5/1989 |
| GB | 2162076 | 1/1986 |
| GB | 2186500 | 8/1987 |

*Primary Examiner* — Stephen Crow
*Assistant Examiner* — Garrett Atkinson
(74) *Attorney, Agent, or Firm* — Booth Udall Fuller, PLC

(57) ABSTRACT

Variations of an improved weight bar clamp are disclosed herein. A weight bar clamp includes a collar with two opposing walls that extend from a common end. The collar may be a one-piece collar or a multi-piece collar. The opposing walls may also include an arced interior surface and a plurality of structural ribs. The structural ribs extend in an arc partially between the common end and a terminating end of each opposing wall. The weight bar clamp may further include a biasing member that biases cam halves coupled to the opposing walls away from one another. The clamp further includes handle coupled to the cam halves. The clamp includes a cam opening configured to allow the cam halves to separate in an open position and push the cam halves toward each other in a closed position.

19 Claims, 10 Drawing Sheets

(56) References Cited

U.S. PATENT DOCUMENTS

| | | | | |
|---|---|---|---|---|
| 7,494,451 | B1 * | 2/2009 | Ramos | 482/107 |
| 7,654,939 | B1 * | 2/2010 | Lin | 482/93 |
| 7,666,118 | B1 * | 2/2010 | Anthony | 482/8 |
| 7,841,970 | B2 * | 11/2010 | Striar et al. | 482/93 |
| 8,142,335 | B1 * | 3/2012 | Leach et al. | 482/107 |
| 8,671,530 | B2 * | 3/2014 | Ciminski et al. | 24/494 |
| 2009/0325769 | A1 * | 12/2009 | Miskel | 482/107 |
| 2011/0162173 | A1 * | 7/2011 | Ciminski et al. | 24/303 |

* cited by examiner

WEIGHT BAR CLAMP

BACKGROUND

1. Technical Field

Aspects of this document relate generally to clamps for use with a weight lifting bar.

2. Background Art

Weight bar clamps are important in ensuring the safety of a weight lifter and those around the weight lifter by restricting weights from sliding off a weight lifting bar. Although widely used, previous weight bar clamps are susceptible cracking or other deformations due to the construction of the weight bar clamp. Furthermore, assembly of weight bar clamps is often complex and expensive due to the many parts used.

SUMMARY

Aspects of this document relate to clamps for weight bars.

In one aspect, a weight bar clamp comprising a collar and a handle is contemplated. The collar comprises two opposing walls extending from a common end. Each of the two opposing walls comprise an arced interior surface extending partially about a collar center axis and terminate adjacent each other at a terminating wall end of each wall. A biasing member biases the terminating ends of each wall away from each other. The weight bar clamp further comprises at least two structural ribs on each of the two opposing walls. Each structural rib extends in an arc partially between the common end and the terminating end on its respective wall of the two opposing walls. The ribs on each respective wall are concentric to a common arc axis particular to that respective wall and the common arcs for each of the two opposing walls are parallel with the collar center axis. The weight bar clamp further comprises two cam halves. Each one of the two cam halves is coupled to the terminating end of one of the two opposing walls, and each of the two cam halves comprise an upper lip that extends outward from the respective cam half. The handle comprises a cam opening with a ledge that extends at least partially around the cam opening and engages the upper lip of the two cam halves. The handle is pivotally coupled to the two cam halves, and the cam halves extend into the cam opening such that when the handle is in a first position the biasing member causes the cam halves to separate from each other and in a second position the handle pushes the cam halves toward each other counter to the biasing member's bias.

Particular implementations may include one or more of the following. The common end may comprise a hinge coupling the two opposing walls and the biasing member comprises a spring coupled to the collar between the two cam halves. The weight bar clamp may further comprise a cam follower channel within the handle that leads to the cam opening, a cam follower slidable within the cam follower channel, the cam follower comprising a cam follower face, and a handle spring within the handle biasing the cam follower toward the two cam halves. The cam opening may comprise two arcuate openings aligned in an offsetting configuration that forms two opposing handle stops, and the two cam halves may comprise two arcuate cam halves coupled to each respective terminating wall end in an offset alignment. When the handle is in the first position, the two cam halves may be located in different arcuate openings of the cam opening, at least a portion of each cam halves may abut different handle stops of the two opposing handle stops. When the handle is in the second position, the two cam halves are both partially located in both of the arcuate openings of the cam opening. A first nub may be located substantially central on the arcuate openings of the cam opening. A second nub may be proximate the handle stop on each of the arcuate openings of the cam opening. A detent may protrude from each arcuate cam half and be located substantially central between opposing ends of the arcuate cam half. When the handle is in a first position, the detent may rest within the first nub and when the handle is in a second position, the detent may rest within the second nub. The collar may comprise a single piece and the biasing member comprises a flexible element at the common end of the collar. The flexible element may comprise a narrowing U-shaped element. The two cam halves may form a substantially oblong cam when aligned and the cam opening may comprise a substantially oblong cam opening that comprises a depression on each longer side of the oblong opening. When the handle is in the first position, longer sides of the oblong cam may be substantially parallel to the longer sides of the oblong opening. When the handle is in the second position, the longer sides of the cam may be perpendicular to the longer sides of the cam opening and short sides of the cam may within the depressions of the longer sides of the oblong opening. A magnet may be coupled to at least one of the collar and the handle. Pivoting of the handle may be limited to approximately 90 degrees between the first and second position. The clamp may further comprise a button that locks the handle in the second position.

In another aspect, a weight bar clamp may comprise a collar and a handle. The collar may comprise two opposing walls coupled together with a hinge at a common end. Each of the two opposing walls may comprise an arced interior surface that extends partially about a collar center axis and terminate adjacent each other at a terminating wall end of each wall such that a substantially cylindrical passage is formed when the terminating wall ends abut one another. The clamp may further comprise at least two structural ribs on each of the two opposing walls. Each structural rib may extend in an arc partially between the common end and the terminating end on its respective wall of the two opposing walls. The ribs on each respective wall may be concentric to a common arc axis particular to that respective wall and the common arcs for each of the two opposing walls may be parallel with the collar center axis. Two cam halves may each be coupled to different ones of the two opposing walls. The clamp may further comprise a spring that biases the cam halves away from each other. The spring may be coupled to the collar between the two cam halves. The clamp may further comprise a handle that comprises a cam opening and pivotally coupled to the cam follower. The cam follower may extend into the cam opening such that when the handle is in a first position the spring causes the cam follower halves to separate from each other and when the handle is in a second position the handle pushes the cam halves toward each other counter the springs bias.

Particular implementation may include one or more of the following. The first and second cam halves may comprise a lip that extends from at least a portion of the first and second cam follower halves and engages with a ledge on at least a portion of the cam opening. The weight bar clamp may further comprise a cam follower channel within the handle that leads to the cam opening, a cam follower slidable within the cam follower channel, the cam follower comprising a cam follower face, and a handle spring within the handle biasing the cam follower toward the two cam halves. The cam opening may comprise two semi-circle openings aligned in an offsetting configuration that forms two opposing handle stops in the cam opening. The two cam halves may comprise two semi-circle cam halves coupled to respective terminating wall ends in an offset alignment. When the handle is in the first position, the two cam halves may be located in different ones of the two semi-circle openings of the cam opening, with at least a portion of a planar portion of each cam half abutting different handle stops of the two opposing handle stops. When the handle is in the second position, the two cam halves may both be partially located in both of the semi-circle openings of the cam opening. The weight bar clamp may further comprise a first notch located substantially central to opposing ends of each semi-circle opening of the cam opening, a second notch proximate the handle stop on each of the semi-circle openings of the cam opening, and a nub protruding from each semi-circle cam half. The detent may be located substantially central between opposing ends of the semi-circle cam half. When the handle is in a first position, the detent may rest within the first nub. When the handle is in a second position, the detent may rest within the second nub. The weight bar clam may further comprise a magnet coupled to at least one of the collar and the handle. Pivoting of the handle may be limited to approximately 90 degrees between the first and second position. The weight bar clam may further comprise a button that locks the handle in the second position.

In still another aspect, a weight bar clamp may comprise a handle and a single piece collar. The single piece collar may comprise two opposing walls that extend from a flexible element at a common end of the single piece collar. Each of the two opposing walls may comprise an arced interior surface that extends partially about a collar center axis and may terminate adjacent the other at a terminating wall end of each wall. The flexible element may bias the terminating ends of each wall away from each other. The clamp may further comprise at least two structural ribs on each of the two opposing walls. Each structural rib may extend in an arc partially between the common end and the terminating end on its respective wall of the two opposing walls. The ribs on each respective wall may be concentric to a common arc axis particular to that respect wall. The common arcs for each of the two opposing walls may be parallel with the collar center axis. The clamp may further comprise two cam portions each coupled different terminating ends of each of the two opposing walls. The clamp may further comprise a handle that comprises a cam opening. The handle may be pivotally coupled to the cam portions. The cam portions may extend into the cam opening such that when the handle is in a first position the flexible element causes the two cam portions to separate from each other and when the handle is in a second position the handle pushes the cam portions toward each other counter to the flexible element's bias.

Particular implementation may include one or more of the following. A first of the two cam portions may comprise a substantially cylindrical cam portion and the substantially cylindrical cam portion may comprise a mating portion that extends at least partially beyond the terminating end of the opposing wall to which it is coupled. The mating portion may comprise a slot. A second of the two cam portions may comprise a cam tab that fits within the slot of the substantially cylindrical cam portion. The substantially cylindrical cam portion may comprise at least one groove distal the terminating wall end. The clamp may further comprise a cap that comprises at least one protrusion sized to fit within the at least one groove. The cap may be sized larger than the cam opening such that when the at least one protrusion is slidably engaged within the at least one groove the cap prevents the handle from sliding off the two cam portions. The cam opening may be substantially oblong and comprise a ledge. The two cam portions may each further comprise a lip extending from at least a portion of the two cam portions that engages with at least a portion of the lip. The clamp may further comprise a cam follower channel within the handle that leads to the cam opening, a cam follower slidable within the cam follower channel, the cam comprising a cam follower face, and a spring within the handle biasing the cam toward the two cam portions. The clamp may further comprise a magnet coupled to at least one of the collar and the handle. Pivoting of the handle may be limited to approximately 90 degrees between the first and second position. The clamp may further comprise a button that locks the handle in the second position.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended weight bar clamps and/or assembly procedures for a weight bar clamp will become apparent for use with implementations of weight bar clamps from this disclosure. Accordingly, for example, although particular collars and handles are disclosed, such handles and collars and implementing components may comprise any shape, size, style, type, model, version, measurement, concentration, material, quantity, and/or the like as is known in the art for such weight bar clamps and implementing components, consistent with the intended operation of a weight bar clamp.

Figure 1:
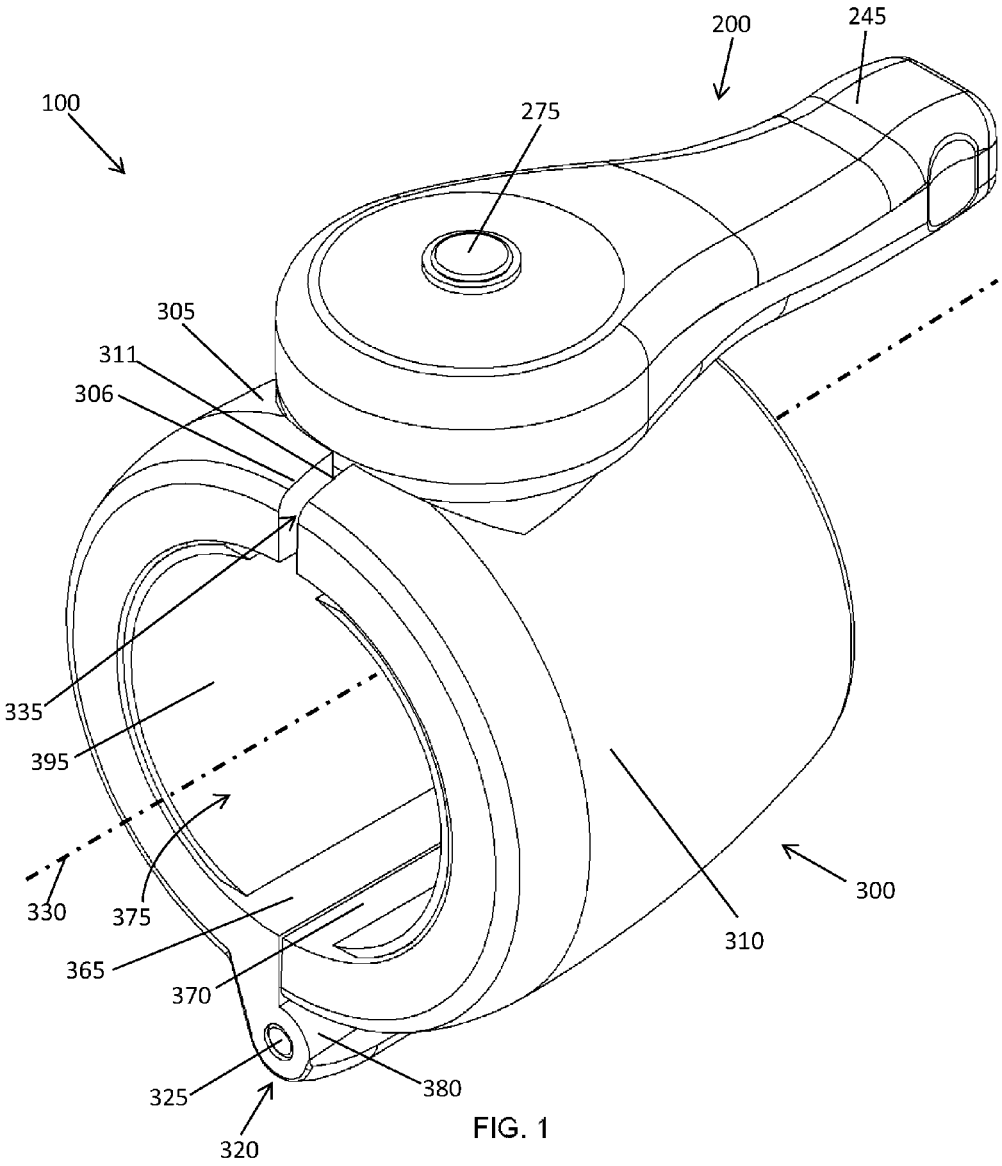
FIG. 1 is a perspective view of a first embodiment of a weight bar clamp in an open position.

FIG. 1 illustrates a perspective view of one aspect of a weight bar clamp 100. In an implementation, weight bar clamp 100 comprises a handle 200 pivotally coupled to a collar 300. In various implementations, the collar 300 comprises two opposing walls 305, 310 extending from a common end 320 of collar 100. A slit 355 opposite the flexing element 320 separates terminating wall ends 306, 311 of two opposing walls 305, 310.

Figure 2:
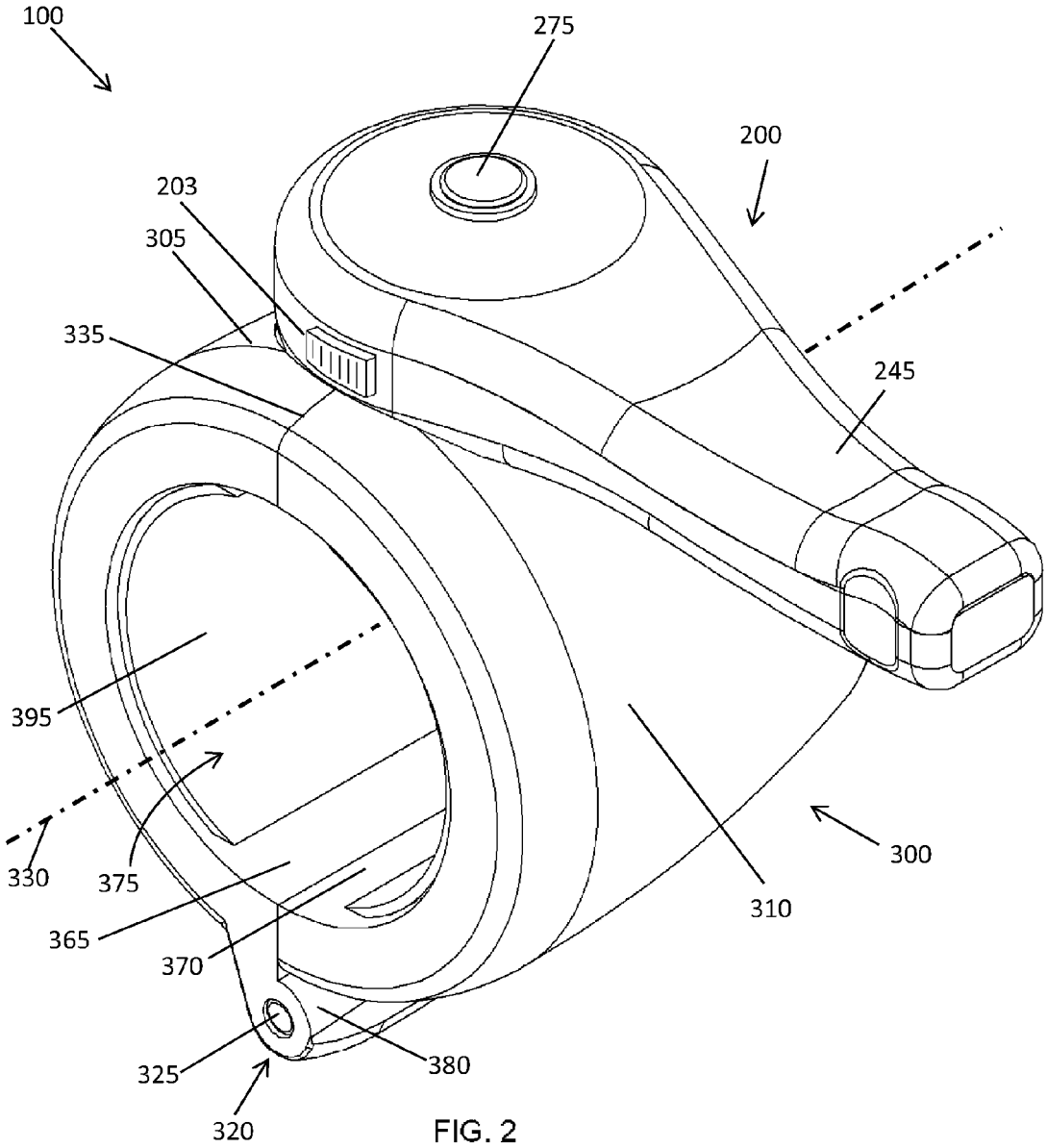
FIG. 2 is a perspective view of the first embodiment of a weight bar clamp in a closed position.
Figure 3:
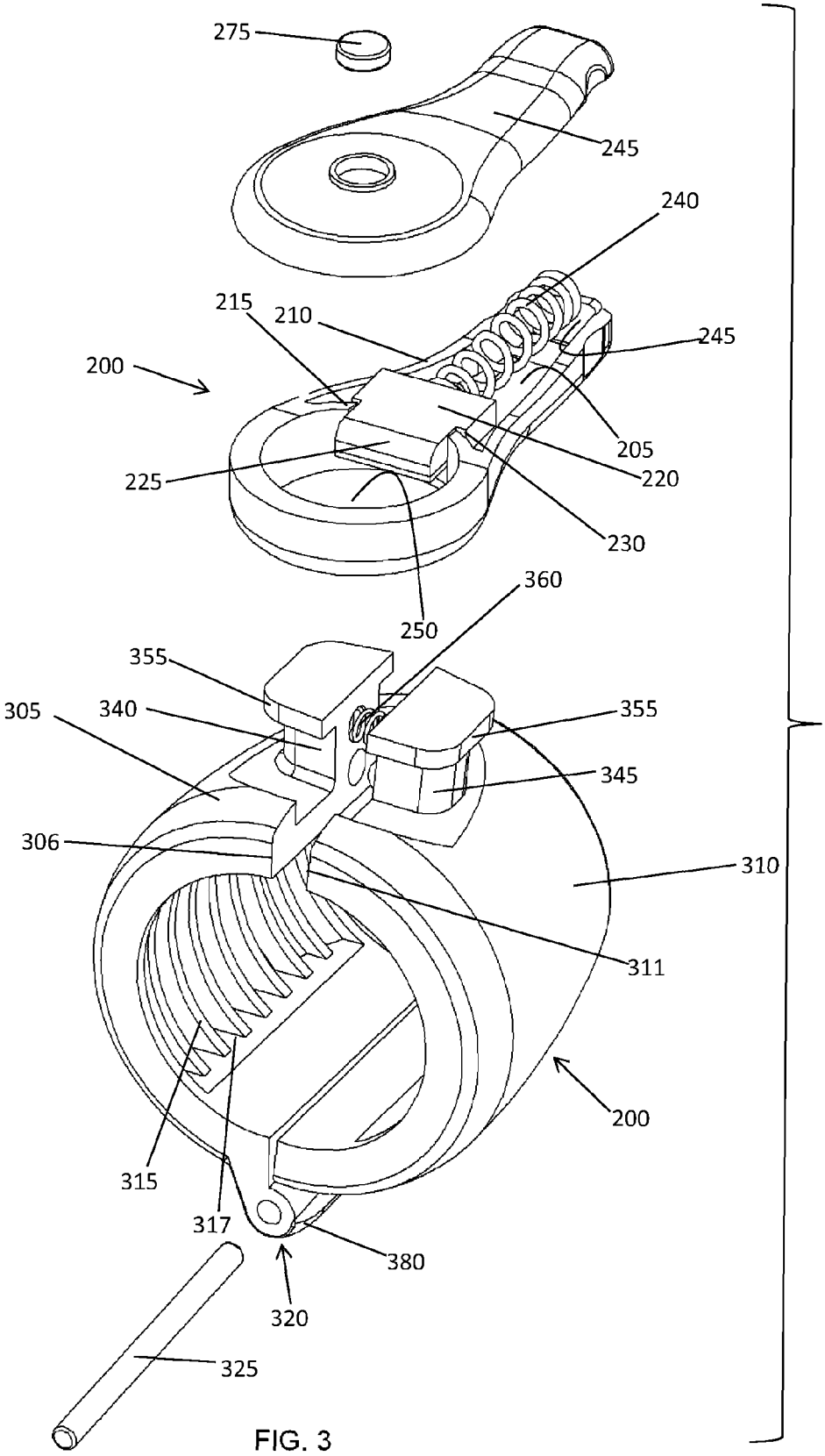
FIG. 3 is an exploded view of the first embodiment of a weight bar clamp.
Figure 4:
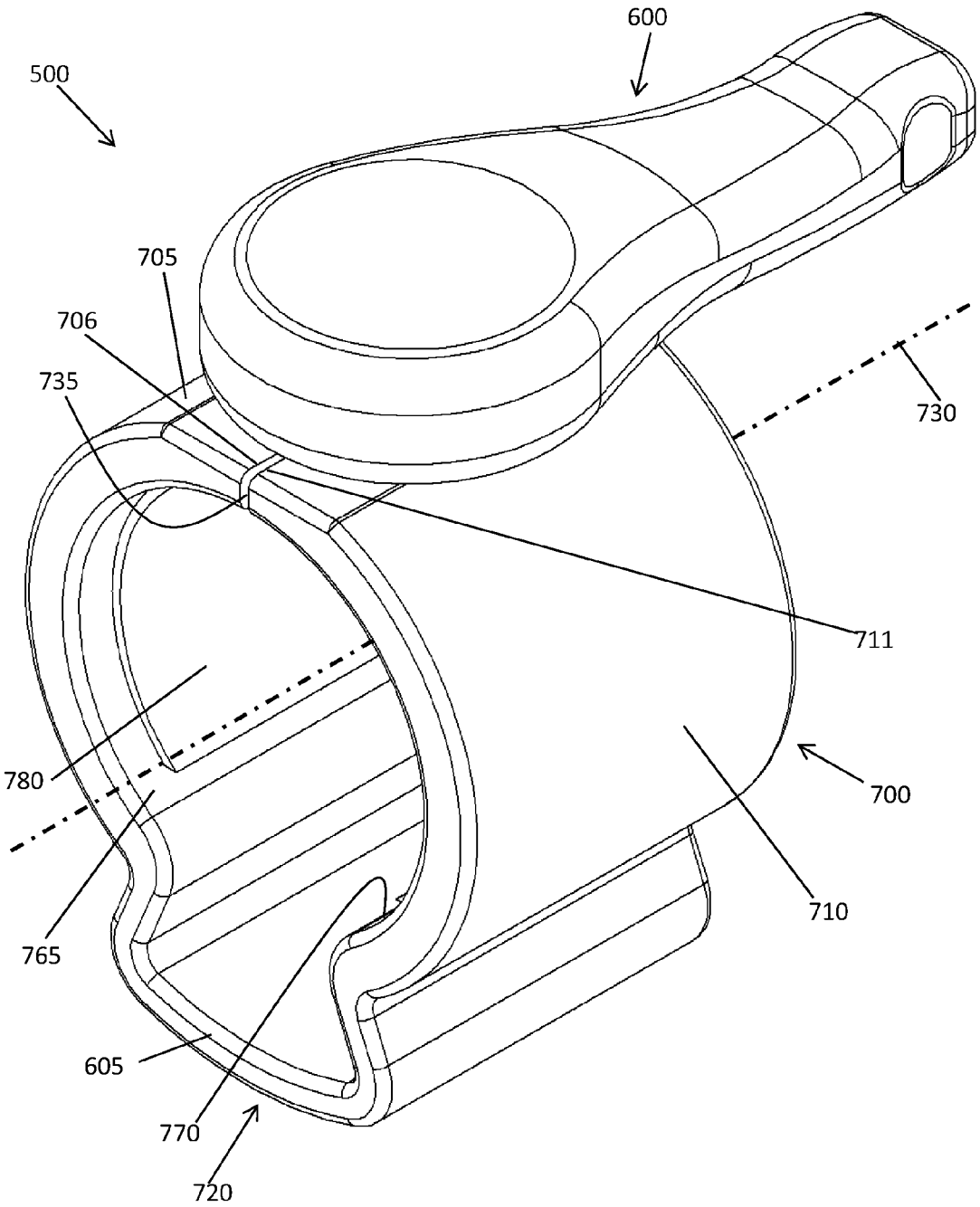
FIG. 4 is a perspective view of a second embodiment of a weight bar clamp in an open position.
Figure 5:
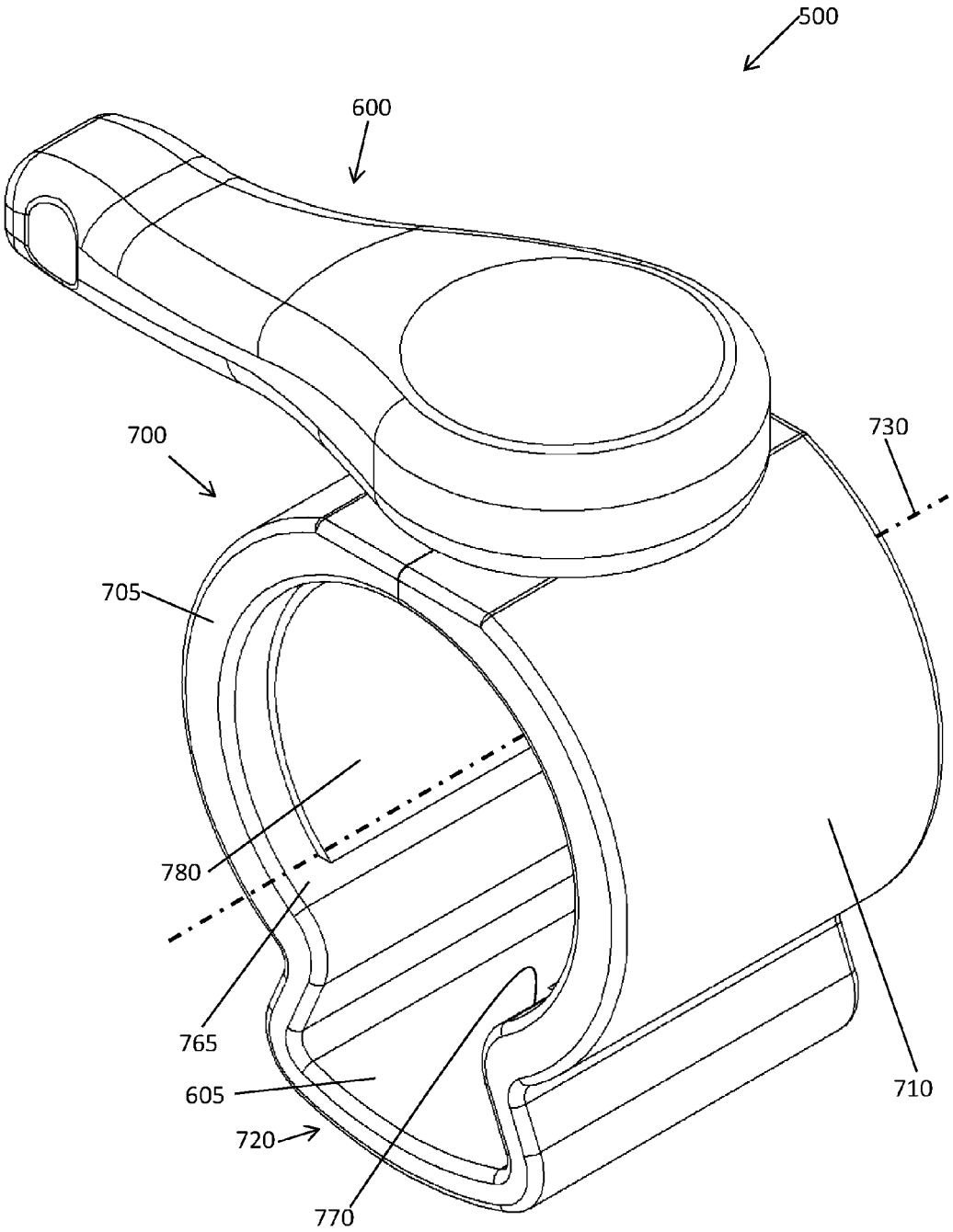
FIG. 5 is a perspective view of the second embodiment of a weight bar clamp in a closed position.

The two opposing walls 305, 310 may comprise two separate pieces, as shown in FIGS. 1-3, or may alternatively comprise a single piece with the common end (see, for example, FIGS. 4-6). In an implementation wherein the two opposing walls 305, 310 comprise two separate pieces, the common end 320 may comprise a hinge that couples the two opposing walls 305, 310 together. In this particular implementation, the common 320 comprises a hinge element comprising a pin 325 that travels through a hole in hinge tabs 380 that protrude from the opposing walls 310, 305. Hinge tabs 380 may comprise separate pieces each coupled to opposing walls 305, 310, or alternatively may comprise a molded-in hinge. In a molded-in hinge, one hinge tab 380 comprises a pin 325 with a snap feature, and the other tab 380 comprises a hole configured to slide one pin 325. In one aspect, the hinge comprises a springed hinge that, in a rested state, biases terminating wall ends 306, 311 away from each other to open the slit 335. Accordingly, terminal wall ends 306, 311 are biased away from each other. In other implementations, the hinge member 320 is not a springed hinge, but another element or elements, such as those disclosed in this application, results in the terminating wall ends 306, 311 being biased away from each other. In still other implementations, the hinge may comprise any type of hinge, such as but not limited to barrel hinges, pivot hinges, butt/mortise hinges, case hinges, continuous hinges, concealed hinges, butterfly hinges, flag hinges, or strap hinges. Any hinge utilized may be molded with the collar, or may alternatively be coupled to the collar after the collar is molded.

Each opposing wall 305, 310 further comprises an arced interior surface 365, 370 extending at least partially about a collar center axis 330. In a particular implementation, the interior surfaces 365, 370 of walls 305, 310 form a substantially cylindrical passage or channel 375 that passes through the collar 100. The cylindrical passage 375 is sized to allow a weight lifting bar to slide through the cylindrical passage when the clamp 100, or its handle 200, is in a first or open position. The cylindrical passage 375 is further sized to restrict the clamp 100 from sliding along the weight lifting bar when the clamp 100 is in a second or closed position. In various implementations, the radius of the arc of the interior surfaces 365, 370 may be sized to allow the clamp 100 to clamp onto particularly sized weight lifting bars. While the interior surfaces 365, 370 may be arced, the exterior surfaces of the opposing walls 305, 310 may comprise any shape. In one aspect, the exterior surfaces of the opposing walls are also arced. In other implementations, the center axis for the arc of the interior surfaces 365, 370 resides outside the passage 375.

According to one aspect, an implementation of a weight bar clamp 100 further comprises at least two structural ribs 315 (see FIG. 3) on each opposing wall 305, 310. Each rib 315 may be arced about the collar center axis 330. In a particular implementation, the at least two structures ribs 315 on each opposing wall 305, 310 each extend in an arc at least partially between the common end 320 and the terminating ends 306, 311 of each respective wall. In such an implementation, the at least two ribs 315 on each respective wall 305, 310 are concentric to a common arc axis particular to that respective wall 305, 310. Thus, the center axes for the each of the arcs on the opposing walls 305, 310 are each also parallel with the collar center axis 33. This alignment of ribs 315 is advantageous over previous weight bar clamps because the rib 315 provides additional structural support to the opposing walls 305, 310. Whereas previous clamps were more susceptible to cracking or other deformations along opposing walls, ribs 315 arced about a collar center axis 330 provide increased structural strength to the clamp 100, thus lessoning the likelihood of cracking or other stress-induced deformations.

Each rib 315 may be configured to protrude from the interior surface 365, 370, be level with the interior surface 365, 370, or be depressed relative to the interior surface 365, 370. In the implementation illustrated in FIG. 1, each rib is depressed within the walls 305, 310 relative to the interior surface 365, 370, and hidden behind a higher friction rib cover 395. In such an implementation, the radius of the arc of the rib 315 from the center axis 330 is typically greater than or approximate to the radius of the arc of the interior surface 365, 370.

According to one aspect, each interior surface 365, 370 comprises a plurality of ribs 315. In such an implementation, each interior surface 365, 370 may comprise at least two ribs 315 spaced from one end of the channel 375 to the opposite end of the channel 375. In other implementations, the ribs may be placed in a variety of alignments and configurations.

In any implementation comprising a rib 315, at least one groove 317 is typically adjacent to the rib 315. Where a plurality of ribs 315 is present on a wall 365, 370, a groove 317 is typically at least between each rib 315. The groove 317 is typically also arced about the collar center axis 330 at a greater radius than the adjacent rib 315.

As shown in FIG. 1-2, a plastic, rubber, foam, or other rib covering 395 or layer may be placed over the ribs 315 (see FIG. 3). The rib cover 395 assists in gripping the clamp to the weight bar when the weight bar is in a closed position. According to various aspects, the ribs 315 may still be apparent under the rib cover due to the configuration of the rib cover, or the ribs 315 may alternatively be unapparent under the rib cover. In an implementation wherein the ribs 315 are still apparent under the rib cover, the rib cover may include rib covers formed over the individual ribs 315. The rib cover may be preformed before application to the clamp 100, or may alternatively be formed as the cover is applied to the clamp 100. In a particular implementation, rib cover 395 comprises a rub or foam cover over molded to the ribs 315.

As illustrated in FIGS. 1-2, a slit 335 is typically present between terminating ends 306, 311 of the opposing walls 305, 310 opposite the common end 320. When the clamp 100 is in an open position, as shown in FIG. 1, the slit 335 is spaced larger than when the clamp 100 is in a closed position (FIG. 2). Typically, when clamp 100 is in a closed position, terminating ends 306, 311 of the walls 305, 310 abut one another and the slit 335 is effectively closed. In other implementations, slit 335 may remain partially open, but cam halves 340, 345 abut one another or substantially abut one another when clamp 100 is closed. In contrast, when clamp 100 is in an open position, terminating ends 306, 311 of the walls 305, 310 typically do not abut one another at the slit 335. Accordingly, terminating ends 306, 311 of the walls 305, 310 are not in direct contact with one another when clamp 100 is in an open position, although incidental contact may occasionally occur. In various implementations, terminating ends 306, 311 of walls 305, 310 may further comprise corresponding teeth or other alignment elements and/or features that provide additional support and strength to clamp 100.

As best shown in the exploded view of FIG. 3, two cam halves 340, 345 are typically coupled together proximate the terminating end 306, 311 of each wall 305, 310 opposite the flexing element 320. When clamp 100 is in a closed position, the two cam halves 340, 345 abut one another to form a substantially oblong or elliptical cam. The cam may comprise a rounded oblong or elliptical shape when viewed from a direction opposite the common end 320. Although the two cam halves 340, 345 may each, in one implementation, comprise half the cam dimensions, certain implementations do not require it. Accordingly, although each element is labeled as a "half," the dimensions relative to each other are not required to be equal.

A spring 360 may be coupled between cam halves 340, 345. Spring 360 may comprise any type of spring, such as but not limited to a coil spring, a leaf spring, and the like. In a particular implementation, spring 360 effectuates a biasing force such that cam halves 340, 345, and terminal wall ends of opposing walls 305, 310 are biased away from one another.

Each of the two cam halves 340, 345 may further comprise a lip 355 extending or otherwise protruding from a side of the two cam halves 340, 345. In the implementation illustrated in FIG. 3, a lip 355 extends from sides of the two cam halves 340, 345 proximate the top surface of the cam halves 340, 345. It is contemplated, however, that a lip 355 may extend from any portion of the side or sides of the two cam halves 340, 345. Lip 355 may, with a cam half 340, 345 comprise a single piece, or may alternatively comprise a separate piece coupled to a cam half 340, 345. In most implementations, the surfaces of the two cam halves 340, 345 that abut when the clamp 100 is in a closed position do not comprise a lip 355. In some implementations, however, a lip 355 may be present on one or both of cam halves 340, 345 at the surface that abuts the other cam follower half. In this configuration, a groove or nook may be present on the surface mates with the lip 355, thus providing additional strength and support to clamp 100 when in a closed position.

As further illustrated in FIGS. 1-3, a handle 200 is typically pivotally coupled to clamp 100. According to one aspect and as shown in FIG. 3, handle 200 comprises a cam opening 250. In the implementation shown in FIG. 3, cam opening 250 is substantially circular in shape. In other implementations, however, cam opening 250 may comprise other shapes, such as the substantially oblong or elliptical cam opening 650 illustrated in FIG. 6. Cam opening 250 may further comprise a cam opening ledge 255 protruding inwardly from cam opening 250.

Handle 200 is typically pivotally coupled to clamp 100 at cam 350. In an implementation, cam 350 extends through cam opening 250 into handle 200. If present, lip 355 of cam halves 340, 345 may interact or otherwise engage with cam opening ledge, thus preventing cam 350 from sliding out of cam opening 250 in particular implementations. In another implementation, the cam lip 355 may engage with the top of cam opening 250 to prevent cam 350 from sliding out of cam opening 250. In still other implementations, other couplings may be utilized to prevent cam 350 from sliding out of cam opening 250, such as but not limited to screws, adhesives, magnets, and the like.

According to one aspect, handle 200 further comprises a cam follower channel 205 that intersects borders or walls of cam opening 250. Cam follower channel 205 is sized to allow sliding or other movement of cam follower 220 within cam follower channel 205. In a particular implementation, cam follower channel 205 extends from an end of the handle distal the cam opening 250 all the ways through to cam opening 250. Cam follower channel 205 typically comprises two cam follower channel walls 210 opposite one another and a cam follower channel base. Cam follower channel walls 210 may comprise the interior surface of sides of handle 200, or may alternatively comprise additional walls provided within handle 200.

In particular implementations, handle 200 further comprises a cam follower 220 slidable within cam follower channel 205. Cam follower 220 comprises a cam follower face 225 positioned to directly contact cam 350 when clamp 100 is in a closed position, thus providing a force against the bias force separating the two cam halves 340, 345. Cam follower 220 may further comprise a cam follower stop 230 on each of two opposing sides of cam follower 220 adjacent to the cam face 225. Cam follower stop elements 230 engage with or directly contact channel stop elements 215 formed at the intersection of the cam follower channel walls 210 and the cam opening 250. Contact between the cam follower stop elements 230 and the channel stop elements 215 allow only a portion of the cam follower 220 to enter the area of the cam opening 250.

According to one aspect, handle 200 further comprises a spring 240 coupled to and between cam follower 220 and a handle end 245 opposite the cam opening 250. The spring 240 may comprise a coiled spring, leaf spring, or any other suitable spring according to various implementations. The spring 240 biases against the cam follower 220 through the cam channel 205 until it directly contacts either the cam halves 340, 345 or the channel stops 215. In some implementations, a spring pin 235 is provided on at least one of the cam 220 and the end 245. The spring pin 235 restricts the spring 240 from slipping or otherwise moving out of its proper position. A handle 200 may further comprise a handle cover 245 coupled to the handle body.

A clamp 100 may further comprise a magnet 275 coupled to or positioned in at least one of the handle 200 and the collar 300. In the implementation illustrated in FIGS. 1-3, the magnet 275 is coupled to the handle 200 opposite the cam opening 250. In other implementations, however, magnet 275 may be coupled to or housed within various locations on the collar 300 or handle 200, such as on the front face of the collar positioned in the annular ring about the center axis 330 (FIG. 1).

In operation, interaction between cam follower 220 and cam halves 340, 345 results in opening of clamp 100 and closing of clamp 100. For example, in FIG. 1, handle 200 is in a first position, cam follower stops 230 are in contact with channel stops 215, thus substantially preventing cam face 225 from contacting directly contacting cam halves 340, 345. As a result, cam halves 340, 345 are biased away from each other, terminating ends of opposing walls 305, 310 opposing the flexing element 320 at the slit 335 do not abut one another, and clamp 100 is in an open position. In an open position, the volume of the channel 375 through clamp 100 is greater than the volume of channel 375 when clamp 100 is in a closed position.

When handle 200 is rotated or pivoted to a second position, typically 90 degrees from the first position, clamp 100 is modified to closed position. Rotation of handle 200 causes cam follower face 225 to directly contact a shorter side of oblong cam halves 340, 345, with the longer sides of oblong cam halves combination positioned between cam follower face 225 and the opposite side of cam opening 250. Therefore, cam follower 220 is biased away from channel stops 215. Simultaneously, spring 240 exerts a force on cam follower 220, pushing cam follower 220 into direct contact with cam halves 340, 345 and pinching or otherwise pushing the two cam follower halves together. This, in turn, causes slit 335 to be closed, thus leaving clamp 100 in a closed position.

Reference is now made to FIGS. 4-5, which illustrate another implementation of weight bar clamp 500. Unless specifically noted to the contrary, various aspects of weight bar clamp 100 may be utilized interchangeably in weight bar clamp 500. For example, similar to other weight bar clamps contemplated in this application, weight bar clamp 500 comprises a handle 600 pivotally coupled to a collar 700. Collar 700 comprises two opposing side walls 705, 710 coupled at common end 720. The two opposing side walls 705, 710 typically comprise an interior surface 765, 770 arced about a center axis 730 of collar 700.

In contrast to one implementation of weight bar clamp 100, collar 700 of weight bar clamp 500 may comprise a single piece collar 700. For example, the common end 720 may comprise a flexing element in the form of a biasing member 605 that couples the two opposing side walls 705, 710 to form a single piece collar 700. As discussed in relation to slit 335 in FIGS. 1-3, slit 735 separates terminating ends 706, 711 of opposing walls 705, 710 opposite the biasing member 605. In further contrast to previously disclosed weight bar clamp, biasing member 605 may comprise piece protruding from and coupling the two opposing walls 705, 710. In the implementation illustrated in FIGS. 4-6, the biasing member 605 comprises a U-shaped flexible biasing member that narrows between the arms of the U as it approaches the opposing side walls 705, 710. In other implementations, the biasing member 605 may comprise any shape that provides the flexibility necessary to allow clamp 500 to be opened and closed.

Biasing member 605 is configured such that the terminating ends 706, 711 of opposing side walls 705, 710 opposing the biasing member 605 are biased away from one another unless a force acts on collar 700 pushing the opposing walls 705, 710 and/or cam halves together. In FIG. 4, no such force is present, and clamp 500 is therefore in an open position with slit 735 separating the terminating ends 706, 711 of opposing walls 705, 710 opposing the biasing member 605.

Like clamp 100, collar 700 of clamp 500 may comprise a plurality of ribs 315 arced about the center axis 730 of collar 700. FIGS. 4-5 illustrate a rib cover 780 similar to rib cover 395 previously described. Like various implementations of rib covers previously described, rib cover 780 may partially protrude from interior surfaces 765, 770 and may assist in gripping a weight bar when clamp 500 is in a closed position.

Figure 6A:
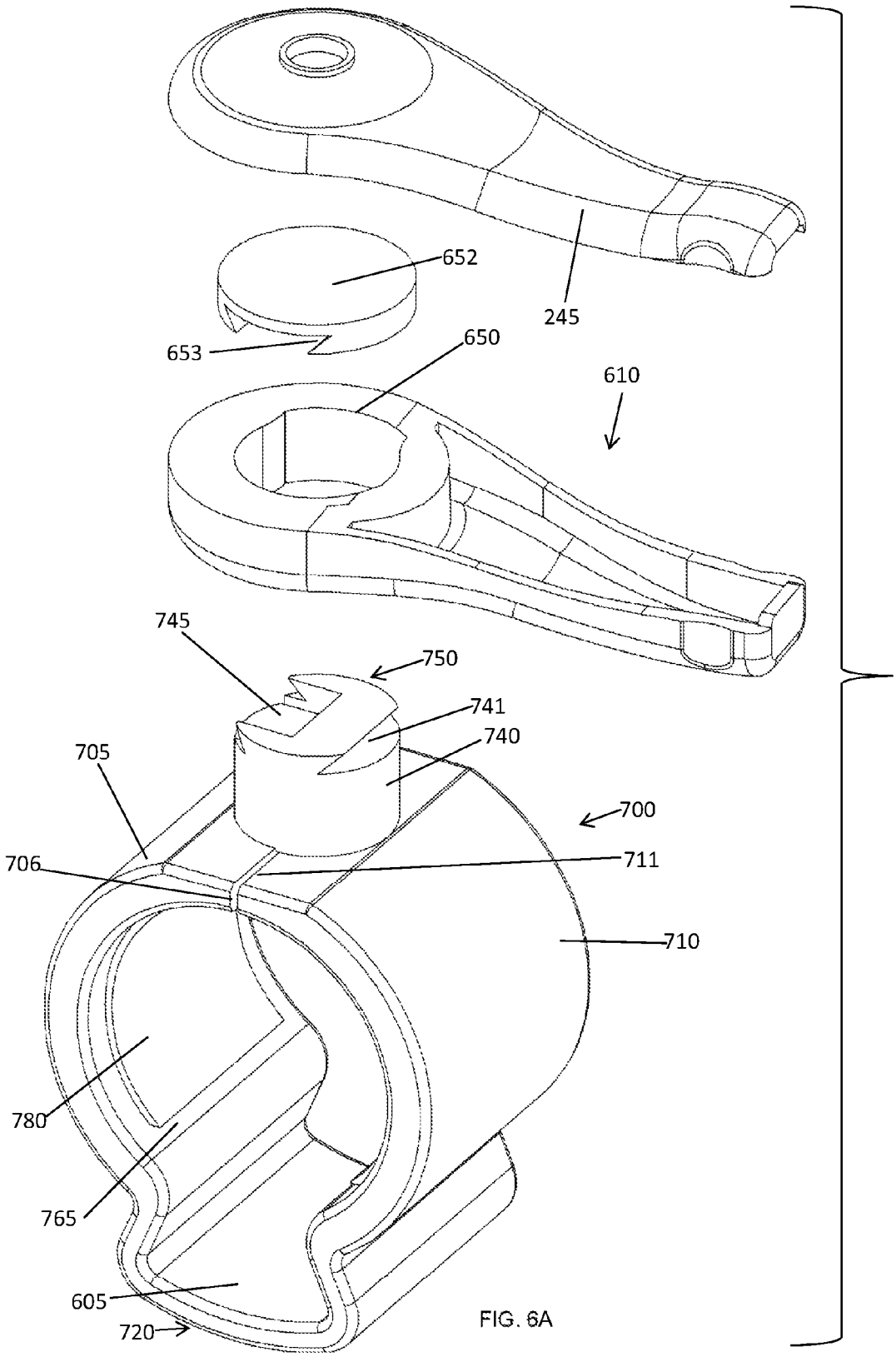
FIG. 6A is an front exploded view of an embodiment of a weight bar clamp with a second handle embodiment.
Figure 6B:
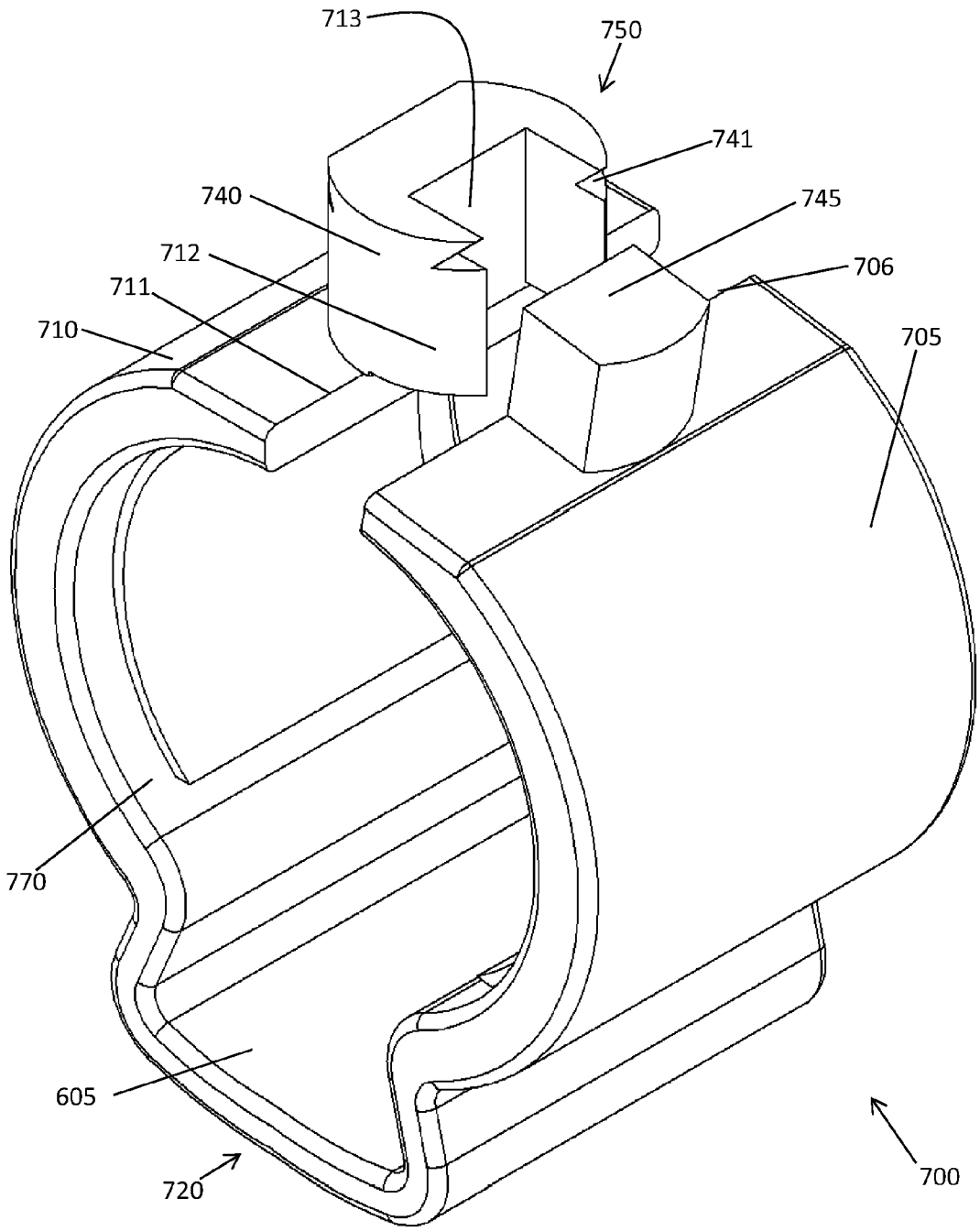
FIG. 6B is a rear close-up perspective view of the collar portion of the embodiment of a weight bar clamp of FIG. 6A with the handle removed.

FIGS. 6A-B illustrate the same collar 700 as in FIGS. 4-5 but with a different handle 610 embodiment. Single piece collar 700 typically comprises two cam halves 740, 745. Each cam half 740, 745 is coupled to a different terminating end 706, 711 of walls 705, 710. In some implementations, cam halves 740, 745 may be similar in configuration to any cam halves disclosed elsewhere throughout this document. In the particular embodiment illustrated in FIG. 6A-B, however, cam 750 is substantially cylindrical in shape and comprised of two different shaped cam halves 740, 745.

In particular, first cam half 740 is coupled to terminating end 711 of wall 710. First cam half 740 comprises substantially cylindrical cam portion with a mating portion 712 that extends beyond terminating end 711 of wall 710. First cam half 740 further comprises a slot 713 on the mating portion 712. In one implementation, the mating portion 712 is raised at the base to fit over the adjacent terminating end 706 of wall 705. Second cam half 745 comprises a cam tab sized to fit within slot 713 of the first cam portion 740.

According to one aspect, first cam half 740 further comprises at least one groove 745. Groove 745 is typically distal terminating end 711, near the top of cam half 740. As shown in FIGS. 6A and B, one implementation comprises two grooves 741 substantially parallel to one another and on opposites sides of first cam half 740. One groove 741 of cam half 740 is partially separated by slot 713. Grooves 741 are sized to allow protrusions 653 on a cap 652 to slide within grooves 741. Although grooves 741 in FIGS. 6A and B are angled grooves, other implementations may comprise rounded grooves.

An implementation of clamp 500 may further comprise a cap 652 that couples to cam 750 and prevents cam 750 from sliding out of cam opening 650. For example, once cam 750 is pushed or otherwise located within and through cam opening 650, cap 652 may be removably coupled to the cam 750 by sliding the protrusions 653 of the cap 652 into grooves 741 of cam 750. Cap 652 is typically sized larger than cam opening 650, thus restrict cam 750 from sliding out of the cam opening 650 when cap 652 is coupled to cam 750. Cap 652 provides a lip for the cam halves about the top of the cam halves to interact with the handle cam opening 650 to assist in holding the handle 600 to the collar 700.

Like other implementations, rotation of handle 600 and cam opening 650 opens and closes clamp 500. For example, cam opening 650 may comprises various tabs, protrusions, and the like configured to overcome the bias force of the biasing member 605 when the clamp 500 and push the second cam half 745 within slot 713 of the first cam half 740 to close the clamp 500. Similarly, cam opening 650 may comprise various depressions, grooves, and the like that allow the bias force of the biasing member 605 to separate the cam halves 740, 745 from one another to open the clamp 500.

In other implementations, when clamp 500 is in a closed position, the two cam halves abut one another to form a substantially oblong or elliptical cam. Cam follower may comprise a rounded oblong or elliptical shape when viewed from a direction opposite the flexing element 605. Although the two cam halves each typically comprise half the cam dimensions, certain implementations do not require it. Accordingly, although each element is labeled as a "half," the dimensions relative to each other are not required to be equal.

In some implementations, each of two cam follower halves further comprise a lip extending or otherwise protruding from a side of the two cam follower halves 740, 745. In a particular implementation, the lip extends from sides of the two cam follower halves 740, 745 proximate the top surface of the cam follower halves 740, 745. It is contemplated, however, that lip may extend from any portion of the side or sides of the two cam follower halves 740, 745. In most implementation, the surfaces of the two cam follower halves 740, 745 that abut when clamp 500 is in a closed position do not comprise a lip. In some implementations, however, a lip may be present on one or both of cam follower halves 740, 745 at the surface that abuts the other cam follower half. In this configuration, a groove or nook may be present on the surface mates with the lip, thus providing additional strength and support to clamp 100 when in a closed position.

As further illustrated in FIGS. 4-5, a handle 600 is typically pivotally coupled to clamp 500. In the implementation shown in FIG. 6, cam opening 650 is substantially oblong or elliptical in shape. Cam opening 650 may further comprise a cam opening ledge protruding inwardly from cam opening 650.

In an alternative implementation, handle 600 is typically pivotally coupled to clamp 500 at cam 750. In an implementation, cam 750 extends through cam opening 650 into handle 600. If present, lip 755 of cam halves 740, 745 may interact or otherwise engage with cam opening ledge 655, thus preventing cam 750 from sliding out of cam opening 650 in particular implementations. In other implementations, other couplings may be utilized to prevent cam follower 750 from sliding out of camp opening 650, such as but not limited to screws, adhesives, magnets, and the like.

In operation of a particular implementation, interaction between an oblong or elliptical cam opening 650 and the cam 750 results in opening and closing of the clamp 500. For example, when handle 610 is in a first position, slit 735 is open and cam halves 740, 745 do not abut one another. This is resultant from the biasing member 605 that induces a tendency for slit 735 to be open unless other forces are acting on at least one of the biasing 605, opposing walls 705, 710, or the cam halves 740, 745. In an open position, long sides of oblong cam opening 650 and cam follower 750 are substantially parallel. Because the cam follower typically comprises an oblong of smaller dimensions than the oblong of cam opening 650, cam opening 650 does not force slit 735 closed when the long sides of oblong cam opening 650 and cam 750 are substantially parallel.

When handle 600 is rotated or pivoted to a second position, typically 90 degrees from the first position, clamp 500 is modified to closed position. Rotation of handle 600 causes long sides of oblong cam opening 650 and cam 750 to be perpendicular to one another. Because the dimensions long side of oblong cam 750 are greater than the dimension of the small side of oblong cam opening 650, cam opening 650 forces slit 735 closed such that cam follower halves 740, 745 abut one another. In some implementations, cam opening 650 may comprise a nook for the short sides of cam 750 to rest or lock in when clamp 500 is in a closed position.

Figure 7A:
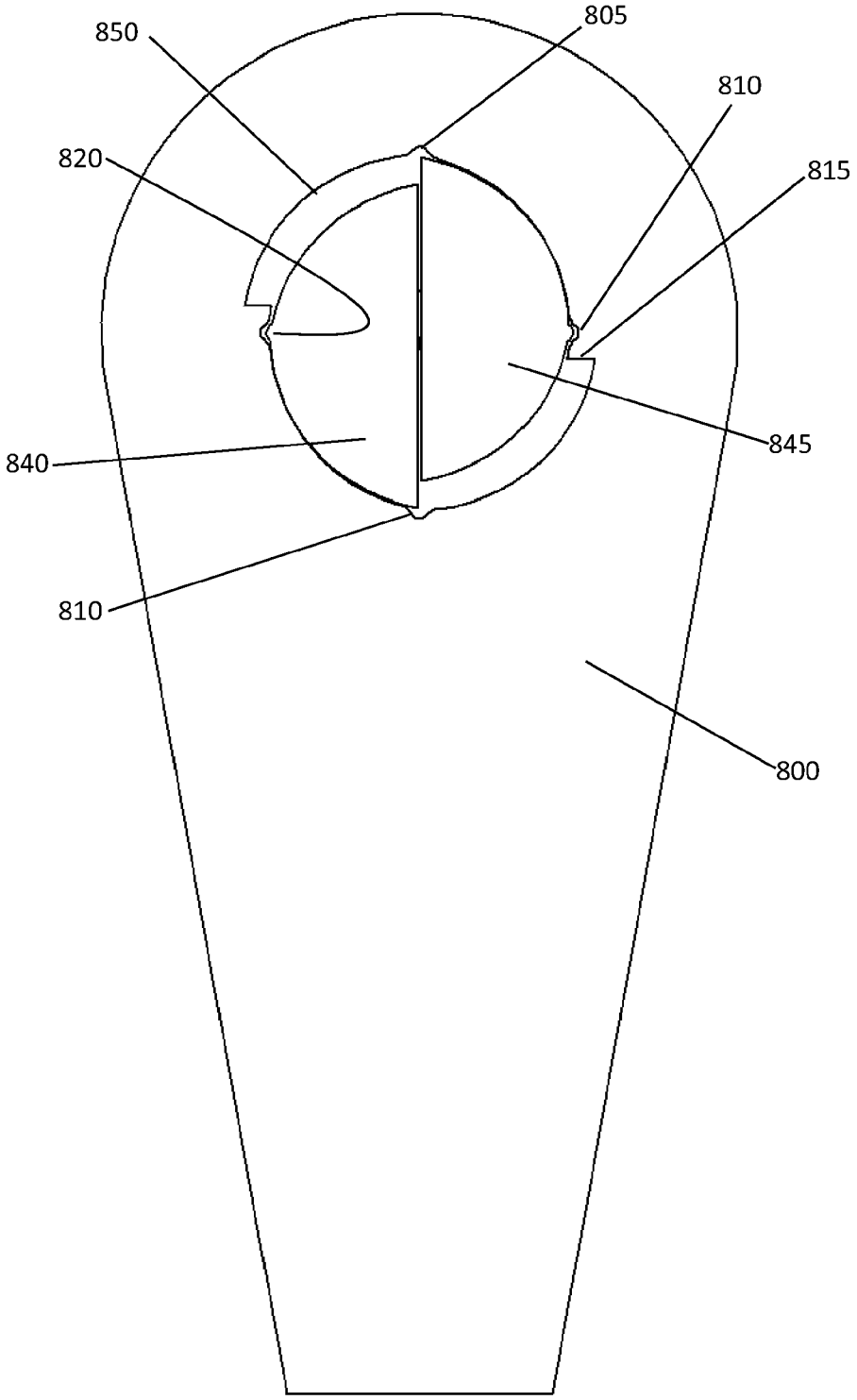
FIG. 7A is a top view of a third handle embodiment illustrating the handle in a closed position.
Figure 7B:
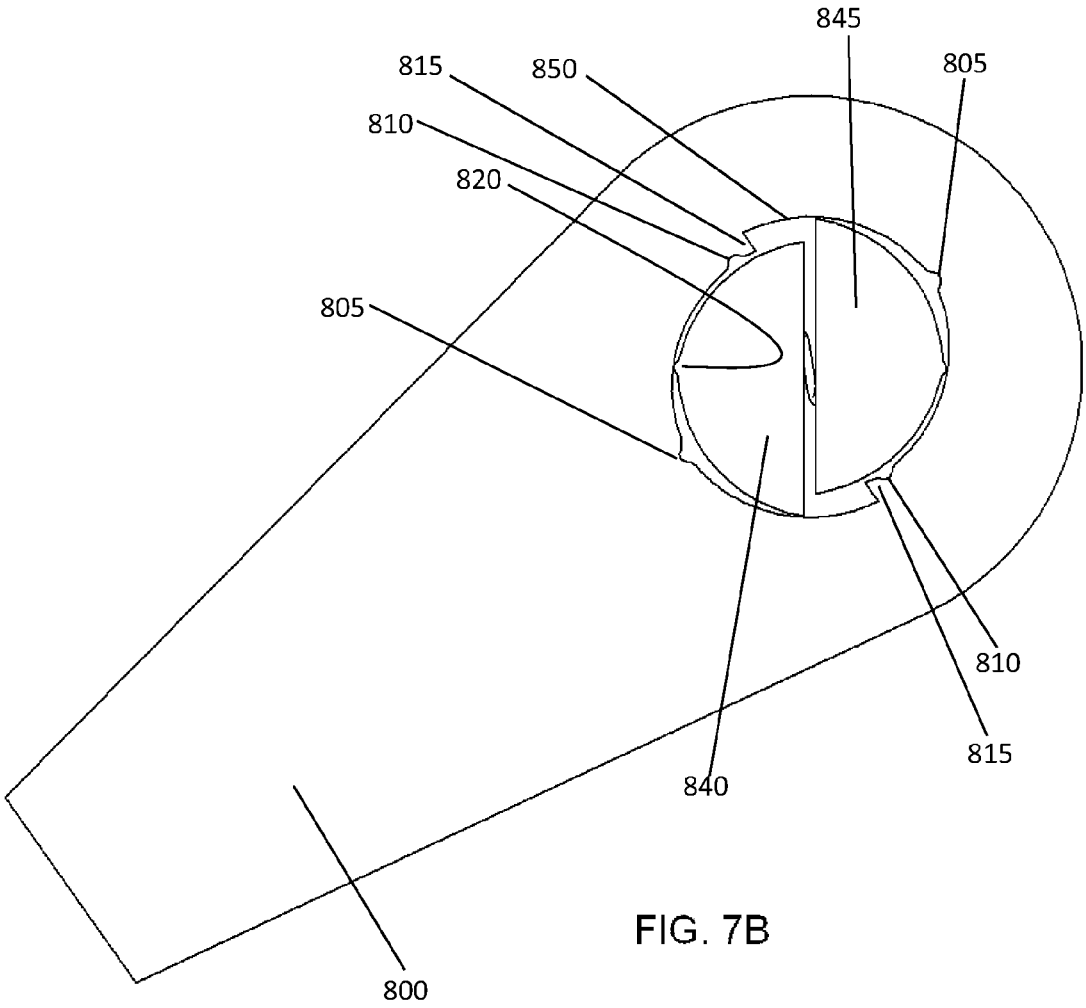
FIG. 7B is a top view of the third handle embodiment illustrating the handle in an intermediate position.
Figure 7C:
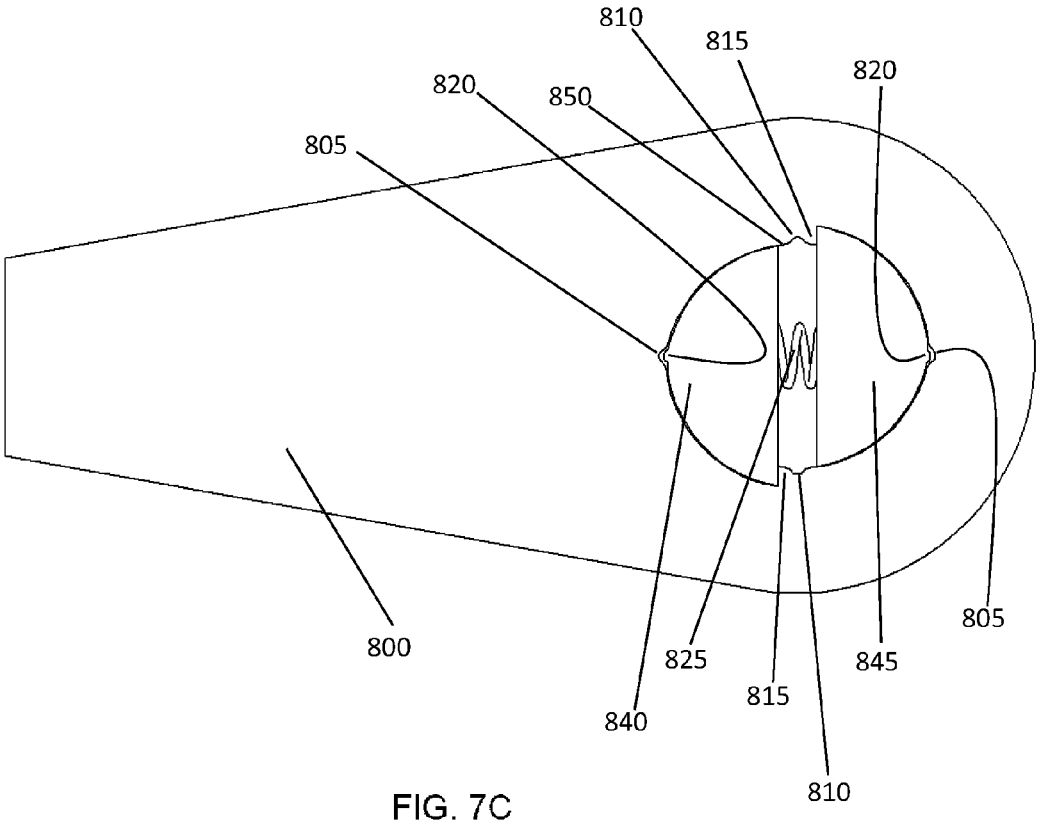
FIG. 7C is a top view of the third handle embodiment illustrating the handle in an open position.

Referring now to FIGS. 7A-7C, various implementations of hinged collars or one piece collars may comprise a positive lock configuration in cam opening 850 and handle 800. As illustrated in FIGS. 7A-7C, the positive lock element prevents handle 800 from pivoting beyond the first and second positions, thus limiting movement of handle 800 to approximately 90 degrees. The positive lock elements may comprise tabs, teeth, springs, or other elements that prohibit movement beyond the 90 degrees described.

In one aspect, handle 800 may comprise a cam opening 850 comprising two semi-circle or arcuate openings aligned in an offsetting configuration. In an implementation comprising arcuate openings, the arcuate openings may form a substantially elliptical shaped-opening. Accordingly, the center points of each semi-circle opening are offset from one another. In a particular implementation, the two semi-circles openings comprise two half-circles. In the implementation illustrated in FIGS. 7A-7C, however, the two semi-circles opening comprise semi-circles with an arc greater than a half-circle.

The offset configuration of the two arcuate openings of cam opening 850 result in two opposing handle stops 815 formed where the two arcuate openings are joined. In some implementations, the two arcuate openings of cam opening 850 each further comprise at least one notch. For example, the implementation shown in FIGS. 7A-7C comprises two notches 805, 810 on each arcuate opening of the cam opening 850. A first notch 805 is typically located proximate a center point on the arc of each arcuate opening of cam opening 850. In some implementations, the first notch 805 is exactly at the center point on the arc of each arcuate opening, while in other implementations, the first notch 805 is within 45 degrees of the center point on the arc of the arcuate opening. A second notch 810 is typically located proximate each handle stop 815 of cam opening 850.

According to one aspect, handle 800 is pivotally coupled to cam halves 840, 845. Cam halves 840, 845 may be coupled to a hinged to piece collar such as collar 300, or alternatively coupled to a single piece collar such as collar 700. In other implementations, cam halves 840, 845 may be coupled to any collar known in the art. Cam halves 840, 845 typically each comprise a half-circle or arcuate cam half sized to fit within one arcuate opening of cam opening 850.

Cam halves 840, 845 may further comprise a nub 820 protruding from the arced side of each cam half 840, 845. In a particular implementation, nub 820 protrudes from a point on the arced side of each cam half 840, 845 substantially central between opposing ends of the arced side of each cam half 840, 845. While nubs 820 and notches 805, 810 are on the cam halves 840, 845 and cam opening 850, respectively, in FIGS. 7A-7C, in other implementations detent elements may located elsewhere on the cam handle 800 and cam halves 845. For example, detent elements may be located on an underside of handle 800 and/or cam halves 840, 845 in other implementations.

In a particular implementation, a spring 820 may be coupled between cam halves 840, 845. Spring 820 provides a bias force sufficient to bias cam halves 840, 845 away from each other unless another force counter the bias force pushes cam halve 840, 845 together. In other implementations, spring 820 is not present, but the collar may comprise a biasing member previously described in this document.

FIGS. 7A-7C show cam halves 840, 845 with a lip, similar to that in previous embodiments, removed for clarity of illustration, and a handle 800 at various stages of operation. In FIG. 7A, handle 800 is shown in a second position that closes the clamp. Accordingly, in the closed position, the cam halves 840, 845 abut one another within cam opening 850. As illustrated, when handle 800 is in a second position closing the clamp, cam halves 840, 845 are both partially located in both arcuate openings of cam opening 850. When in this second, closed position, the end of handle 800 comprising the cam opening 850 is in hoop stress, meaning this area is providing all of the clamping pressure. In contrast, previously known clamps use the spring in the handle to force cam halves together in a closed clamp position. This configuration is also advantageous because it uses fewer parts than previously known weight bar clamps, resulting in easier assembly and cheaper manufacturing costs.

In a particular implementation, nubs 820 on cam halves 840, 845 rest within the second notches 810 when handle 800 is in a closed position. While neither cam halves 840, 845 abut handle stops 815 when handle 800 is in a closed position, engagement between the nubs 820 and second notches 810 assist in preventing handle 800 from rotating or pivoting undesirably. Furthermore, the unique configuration of cam opening 850 and the cam halves 840, 845 restrict handle 800 from rotating or pivoting beyond the second or closed position.

FIG. 7B shows handle 800 halfway between the open first position (FIG. 7C) and the closed second position (FIG. 7A). As the handle is rotated from its closed position to its opened position, the distance between cam halves 740, 745 typically grows. Additional notches may be placed on cam opening 850 to stop handle rotation in various steps.

FIG. 7C shows handle 800 in an open first position. In this position, cam halves 840, 845 are each located in different semi-circles of cam opening 850. Furthermore, a portion of each cam half 840, 845 abuts a different handle stop 815, thus preventing rotation or pivoting of handle 800 beyond the first position. As shown, when cam halves 840, 845 are each located in different semi-circles of cam opening 850, spring 825 (or any other biasing member) forces the cam halves away from one another, thus allowing the clamp to rest in an open position. In the implementation illustrated in FIG. 7C, nubs 820 rest within notches 805 to further assist in stabilizing handle 800 in this position and give positive tactile feedback as to the position of the handle.

In still other implementations of clamps 100, 500, a positive locking element may be provided that restricts pivoting of handle 200, 600 unless a button 203 (shown in FIG. 2) on handle 200, 600 is pressed to actuate a brace that locks the handle into the closed position. This positive locking element and its attendant parts may be added to any of the various handle embodiments shown or described herein.

The handle embodiments described with reference to any of the FIGs. may be used on any of the other collar embodiments described herein and are not restricted to the particular clamp embodiments in which they are described. Those of ordinary skill in the art will readily understand how to adapt the cam halves and cam openings of the various handle designs to function properly with the other collar embodiments given the discussion of the various components herein.

It will be understood that implementations are not limited to the specific components disclosed herein, as virtually any components consistent with the intended operation of a method and/or system implementation for weight bar clamps may be utilized. Accordingly, for example, although particular collars and handles may be disclosed, such components may comprise any shape, size, style, type, model, version, class, grade, measurement, concentration, material, weight, quantity, and/or the like consistent with the intended operation of a method and/or system implementation for a weight bar clamp may be used.

In places where the description above refers to particular implementations of collars and handles, it should be readily apparent that a number of modifications may be made without departing from the spirit thereof and that these implementations may be applied to other collars and handles of weight bar clamps. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A weight bar clamp, comprising:

a collar comprising two opposing walls extending from a common end, each of the two opposing walls comprising an arced interior surface extending partially about a collar center axis and terminating adjacent each other at a terminating wall end of each wall, wherein a biasing member biases the terminating ends of each wall away from each other;

at least two structural ribs on each of the two opposing walls, each structural rib extending in an arc partially between the common end and the terminating end of a respective wall of the two opposing walls, wherein the ribs on each respective wall are spaced from respective side ends of the wall, concentric to a common arc axis particular to that respective wall, and the common arcs for each of the two opposing walls are parallel with the collar center axis;

two cam halves, each one of the two cam halves coupled to the terminating end of one of the two opposing walls, each of the two cam halves comprising an upper lip separate from the upper lip of the other of the two cam halves and extending outward from the respective cam half;

a handle comprising a cam opening with a ledge extending at least partially around the cam opening and engaging the upper lip of the two cam halves, the handle pivotally coupled to the two cam halves, wherein the cam halves extend into the cam opening such that when the handle is in a first position the biasing member causes the cam halves to separate from each other and in a second position the handle pushes the cam halves toward each other counter to the biasing member's bias.

2. The weight bar clamp of claim 1, wherein the common end comprises a hinge coupling the two opposing walls and the biasing member comprises a spring coupled to the collar between the two cam halves, and the structural ribs are depressed relative to the interior surface each wall.

3. The weight bar clamp of claim 2, further comprising:

a cam follower channel within the handle that leads to the cam opening;

a cam follower slidable within the cam follower channel, the cam follower comprising a cam follower face;

a handle spring within the handle biasing the cam follower toward the two cam halves.

4. The weight bar clamp of claim 2, wherein the cam opening comprises two arcuate openings aligned in an offsetting configuration that forms two opposing handle stops, and the two cam halves comprise two arcuate cam halves coupled to each respective terminating wall end in an offset alignment; and wherein when the handle is in the first position, the two cam halves are located in different arcuate openings of the cam opening, at least a portion of each cam halves abutting different handle stops of the two opposing handle stops, and when the handle is in the second position, the two cam halves are both partially located in both of the arcuate openings of the cam opening.

5. The weight bar clamp of claim 4, further comprising:

a first nub located substantially central on the arcuate openings of the cam opening;

a second nub proximate the handle stop on each of the arcuate openings of the cam opening;

a detent protruding from each arcuate cam half, the detent located substantially central between opposing ends of the arcuate cam half;

wherein when the handle is in a first position the detent rests within the first nub and when the handle is in a second position, the detent rests within the second nub.

6. The weight bar clamp of claim 1, wherein the collar comprises a single piece and the biasing member comprises a flexible element at the common end of the collar.

7. The weight bar clamp of claim 6, wherein the flexible element comprises a narrowing U-shaped element.

8. The weight bar clamp of claim 7, wherein the two cam halves form a substantially oblong cam when aligned and the cam opening comprises a substantially oblong cam opening comprising a depression on each longer side of the oblong opening, wherein when the handle is in the first position longer sides of the oblong cam are substantially parallel to the longer sides of the oblong opening, and when the handle is in the second position the longer sides of the cam are perpendicular to the longer sides of the cam opening and short sides of the cam rest within the depressions of the longer sides of the oblong opening.

9. The weight bar clamp of claim 1, further comprising a magnet coupled to at least one of the collar and the handle.

10. The weight bar clamp of claim 1, wherein pivoting of the handle is limited to approximately 90 degrees between the first and second position.

11. The weight bar clamp of claim 1, further comprising a button that locks the handle in the second position.

12. A weight bar clamp, comprising:

a collar comprising two opposing walls coupled together with a hinge at a common end, each of the two opposing walls comprising an arced interior surface extending partially about a collar center axis and terminating adjacent each other at a terminating wall end of each wall such that a substantially cylindrical passage is formed when the terminating wall ends abut one another;

at least two structural ribs on each of the two opposing walls, each structural rib extending in an arc partially between the common end and the terminating end of a respective wall of the two opposing walls, wherein the ribs on each respective wall are spaced from respective side ends of the wall, concentric to a common arc axis particular to that respective wall, and the common arcs for each of the two opposing walls are parallel with the collar center axis;

two cam halves each coupled to different ones of the two opposing walls;

a spring that biases the cam halves away from each other coupled to the collar between the two cam halves;

a handle comprising a cam opening and pivotally coupled to the two cam halves, wherein the cam follower extends into the cam opening such that when the handle is in a first position the spring causes the cam halves to separate from each other and when the handle is in a second position the handle pushes the cam halves toward each other counter the springs bias.

13. The weight bar clamp of claim 12, wherein the first and second cam halves each comprise a lip extending from at least a portion of the first and second cam halves that engages with a ledge on at least a portion of the cam opening and the plurality of structural ribs are depressed relative to the interior surface of each wall.

14. The weight bar clamp of claim 13, further comprising:

a cam follower channel within the handle that leads to the cam opening;

a cam follower slidable within the cam follower channel, the cam follower comprising a cam follower face;

a handle spring within the handle biasing the cam follower toward the two cam halves.

15. The weight bar clamp of claim 12, wherein:

the cam opening comprises two semi-circle openings aligned in an offsetting configuration that forms two opposing handle stops in the cam opening;

the two cam halves comprise two semi-circle cam halves coupled to respective terminating wall ends in an offset alignment; and when the handle is in the first position, the two cam halves are located in different ones of the two semi-circle openings of the cam opening, at least a portion of a planar portion of each cam half abutting different handle stops of the two opposing handle stops, and when the handle is in the second position, the two cam halves are both partially located in both of the semi-circle openings of the cam opening.

16. The weight bar clamp of claim 15, further comprising:

a first notch located substantially central to opposing ends of each semi-circle opening of the cam opening;

a second notch proximate the handle stop on each of the semi-circle openings of the cam opening;

a nub protruding from each semi-circle cam half, the detent located substantially central between opposing ends of the semi-circle cam half;

wherein when the handle is in a first position the detent rests within the first nub and when the handle is in a second position, the detent rests within the second nub.

17. The weight bar clamp of claim 12, further comprising a magnet coupled to at least one of the collar and the handle.

18. The weight bar clamp of claim 12, wherein pivoting of the handle is limited to approximately 90 degrees between the first and second position.

19. The weight bar clamp of claim 12, further comprising a button that locks the handle in the second position.

* * * * *